US006422218B1

(12) United States Patent
Neuschwander

(10) Patent No.: US 6,422,218 B1
(45) Date of Patent: Jul. 23, 2002

(54) DEVICE FOR RECIRCULATING EXHAUST GASES IN AN INTERNAL COMBUSTION ENGINE

(75) Inventor: Helmut Neuschwander, Ludwigsburg (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/623,677

(22) PCT Filed: Feb. 11, 1999

(86) PCT No.: PCT/EP99/00896

§ 371 (c)(1),
(2), (4) Date: Nov. 15, 2000

(87) PCT Pub. No.: WO99/45265

PCT Pub. Date: Sep. 10, 1999

(30) Foreign Application Priority Data

Mar. 7, 1998 (DE) ..... 198 09 861

(51) Int. Cl.[7] ..... F02M 25/07

(52) U.S. Cl. ..... 123/568.12; 123/568.15

(58) Field of Search ..... 123/568.12, 568.15

(56) References Cited

U.S. PATENT DOCUMENTS 4,474,008 A * 10/1984 Sakurai et al. ..... 123/568.27
5,771,868 A * 6/1998 Khair ..... 123/568.15

* cited by examiner

*Primary Examiner*—Willis R. Wolfe
*Assistant Examiner*—Arnold Castro
(74) *Attorney, Agent, or Firm*—Crowell & Moring LLP

(57) ABSTRACT

A device for recirculating exhaust gases in an internal combustion engine, in which a predeterminable quantity of recirculated exhaust gas is introduced into the inlet port of the internal combustion engine downstream in the direction of flow from a throttle valve (2). A valve (8), such as fixed cycle valve, is inserted into the exhaust gas recirculating line (5) and allows the passage of exhaust gas and/or fresh air at a predetermined cycle/quantity ratio, thereby producing an air/exhaust gas mixture to b introduced into the engine inlet port.

4 Claims, 1 Drawing Sheet

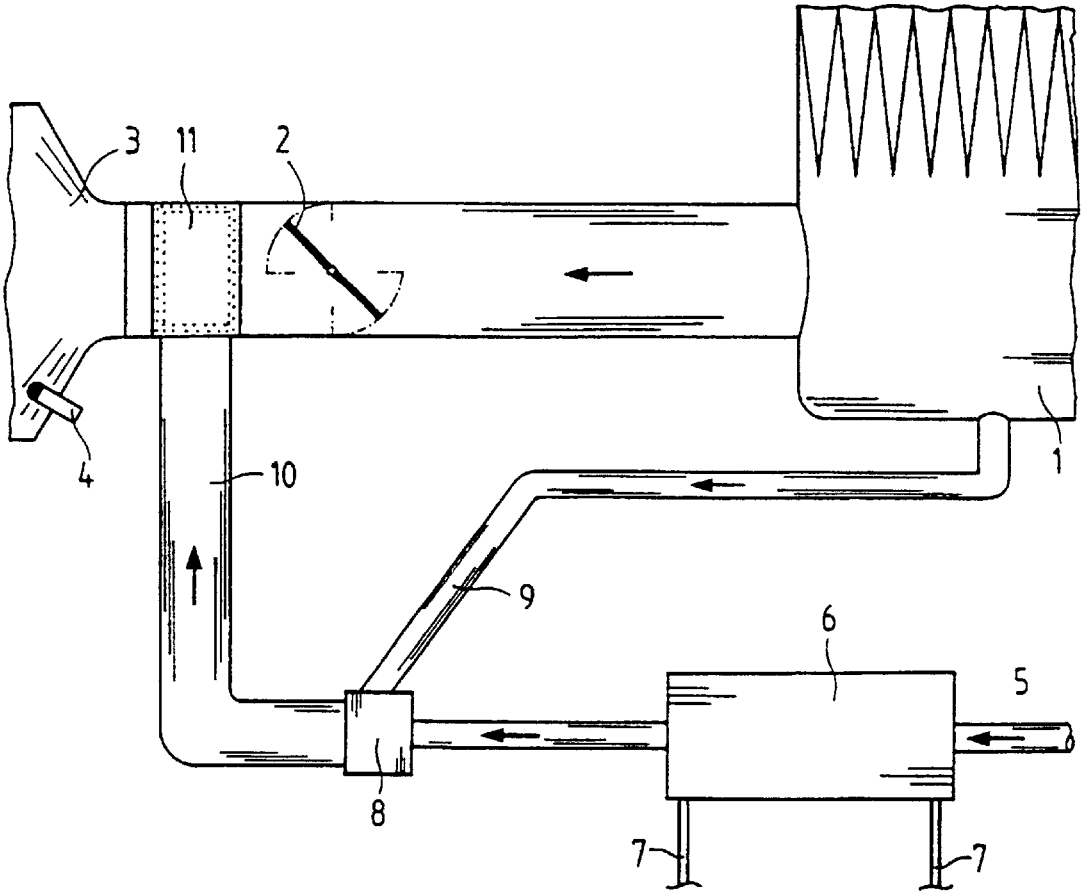
Figure

DEVICE FOR RECIRCULATING EXHAUST GASES IN AN INTERNAL COMBUSTION ENGINE

BACKGROUND OF THE INVENTION

The invention relates to a device for recirculating exhaust gases in an internal combustion engine.

EP 0 128 299 A1, for example, has taught that additional gas streams are introduced into the intake passage of an internal combustion engine behind a throttle valve to form a mixture with the intake air. The flow of the additional gas stream is regulated through a second throttle valve in the passage for the additional gas stream. In different embodiments of the known system either fresh air or recycled exhaust gas is used as additional gas. The temperature of the additional gas stream at the point of introduction is very important to the perfect operation of the system.

SUMMARY OF THE INVENTION

The invention is addressed to the problem of improving an apparatus for the recycling of exhaust gases in an internal combustion engine of the kind described above, such that optimum temperature conditions can be achieved at the point of introduction of the recycled exhaust gas.

The device according to the invention for the recycling of exhaust gas in an internal combustion engine is an advantageous improvement of the generic system, since an amount of recycled exhaust gas that is optimized, especially with regard to temperature, can be introduced into the exhaust passage of the internal combustion engine behind a throttle valve in the direction of flow. For this purpose a valve is inserted into the exhaust gas recycling passage, which admits exhaust gas and/or fresh air in a given quantity ratio, and thus produces a controllable air/exhaust gas mixture for introduction into the intake passage. The fresh air can advantageously be taken from an air filter in the intake tract of the internal combustion engine.

If a cyclically controlled valve is used the quantity ratio can be set advantageously by the cycling ratio, the mixture that is advantageous in each case being controlled by the cyclical addition of air and/or exhaust gas. The cyclical ratio of the cycled valve can in this case be chosen such that the content of the exhaust gas in the air/exhaust gas mixture ranges, for example, from 20% to 40%, the fresh air in one selected embodiment having a temperature of about 60° C. and the exhaust gas a temperature of about 222° C.

By appropriate adaptation to the temperature conditions at the motor, an especially short cold-start phase can be achieved in a motor vehicle with an internal combustion engine. For example, in the case of a mixture ratio of 4:1 (exhaust gas:air) in the supply line and the above-mentioned initial temperatures, a recycled mixture temperature of about 190° C. results at the point of entry into the intake passage; this corresponds to a temperature reduction of 15%.

In the case of a mixture ratio of 3:2 the temperature is about 157.5° C. at a recycled exhaust gas content of 30%; this corresponds in the embodiment approximately to a temperature reduction of 29%. At a mixture ratio of 2:3 the temperature is about 125° C. at a recycled exhaust gas content of 20%; this corresponds to a temperature reduction of about 44%.

In one advantageous embodiment of the device of the invention a cooling device for the recycled exhaust gas is present ahead of the cycled valve in the direction of flow, and is connected to a cooling circuit for the internal combustion engine.

Additional advantageous embodiments will be described hereinafter of the. These and additional features of preferred embodiments of the invention will be found not only in the claims but also in the description and the drawings, the individual features being applicable individually or severally in the form of subcombinations in the embodiment of the invention and in other fields and may represent advantageous as well as independently patentable embodiments, for which protection is hereby claimed.

BRIEF DESCRIPTION OF THE DRAWING

A working embodiment of the device of the invention will be explained with reference to the drawing, wherein the FIGURE shows an outline of an exhaust gas recycling device (EGR) for an internal combustion engine with a cyclically operated valve.

DETAILED DESCRIPTION OF A PREFERRED EMBODIMENT

The sketch in the FIGURE represents the intake tract of an internal combustion engine in which the air is carried from an air filter 1 to a throttle valve 2 and from there into an intake tube 3 for the cylinders of the internal combustion engine. In the intake tube 3 there is a temperature sensor 4.

Also present is an exhaust gas recycling line 5 through which the exhaust gas branched off from the exhaust of the internal combustion engine is passed through a cooling device 6, this cooling device 6 being connected by appropriate connecting lines 7 to the cooling circuit of the internal combustion engine.

After the cooling device 6 the exhaust gas is carried to a first inlet of a cyclically operated valve 8 whose second inlet is connected to the air filter 1 by a fresh air line 9. With the cyclically operated valve 8 an air/exhaust gas mixture is produced, which is carried by a line 10 to an introduction point 11 at which the mixture can flow into the intake stream in front of the air intake stream.

By an appropriate cycling ratio of the cyclical valve 8, it is thus possible, as described in the introduction, to produce for example a mixture in line 10 in which the content of the exhaust gas ranges from 20% to 40%.

What is claimed is:

1. An apparatus for recycling exhaust gases in an internal combustion engine having an air filter, an air intake duct leading from said air filter to the engine, and a throttle valve in said air intake duct; said apparatus comprising an exhaust gas recirculation control valve having first and second inlets and an outlet communicating with said air intake duct between the throttle valve and the engine, an exhaust gas recirculation line leading from an exhaust pipe of the engine to the first inlet of said control valve, and a fresh air line leading from a filtered air source to the second inlet of said control valve, wherein said control valve admixes controlled amounts of exhaust gas and fresh air to produce an air/exhaust gas mixture for introduction into said intake duct and introduces a predeterminable amount of recycled exhaust gas admixed with a prescribed ratio of fresh air into the intake duct of the internal combustion engine, said control valve being cyclically operated such that the prescribed ratio of fresh air to exhaust gas can be adjusted, and wherein the fresh air has a temperature of about 60° C.; the exhaust gas a temperature of about 222° C., and the cycles of the cyclically operated valve are selected such that the proportion exhaust gas in the air/exhaust gas mixture lies in the range from 20% to 40%.

2. An apparatus according to claim 1, wherein the filtered air source is the air filter of the internal combustion engine.

3. An apparatus according to claim 1, further comprising a cooler arranged on said exhaust gas recirculation line for cooling the exhaust gas before the exhaust gas enters the control valve.

4. An apparatus according to claim 3, wherein said cooler is connected to a cooling circuit of the internal combustion engine.

* * * * *